US011015549B1

(12) United States Patent
Ichikawa et al.

(10) Patent No.: US 11,015,549 B1
(45) Date of Patent: May 25, 2021

(54) CYLINDER BLOCK

(71) Applicant: Mazda Motor Corporation, Hiroshima (JP)

(72) Inventors: Kazuo Ichikawa, Aki-gun (JP); Tsuguhisa Miyamoto, Aki-gun (JP); Yoshihisa Nou, Aki-gun (JP); Yuma Miyauchi, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 16/950,170

(22) Filed: Nov. 17, 2020

(30) Foreign Application Priority Data

Nov. 21, 2019 (JP) ..... JP2019-210661

(51) Int. Cl.
*F02B 75/22* (2006.01)
*F02F 7/00* (2006.01)

(52) U.S. Cl.
CPC ..... *F02F 7/0085* (2013.01); *F02F 7/0007* (2013.01)

(58) Field of Classification Search
CPC . F02F 1/004; F02F 1/16; F02F 7/0085; F05C 2253/16; F16J 10/04
USPC ..... 123/193.2, 193.4, 195 R, 668
See application file for complete search history.

(56) References Cited

U.S. PATENT DOCUMENTS 4,466,399 A * 8/1984 Hinz ..... F16J 10/04 123/193.4
6,588,408 B2 * 7/2003 Bedwell ..... F02F 1/16 123/668
2013/0340700 A1 * 12/2013 Donahue ..... F16J 10/04 123/193.2
2017/0067411 A1 * 3/2017 Doho ..... F01P 3/02
2018/0030922 A1 * 2/2018 Kia ..... F02F 7/0085
2019/0277220 A1 * 9/2019 Horigome ..... F02F 1/004

FOREIGN PATENT DOCUMENTS

JP 2019015227 A 1/2019

* cited by examiner

*Primary Examiner* — Long T Tran
*Assistant Examiner* — James J Kim
(74) *Attorney, Agent, or Firm* — Alleman Hall Creasman & Tuttle LLP

(57) ABSTRACT

A cylinder block includes a body part where a cylinder is formed, an outer wall part made of fiber reinforced resin and surrounding an outer circumference of the body part, and a metal member attached to the outer wall part. The outer wall part is comprised of an inner layer surrounding the outer circumference of the body part, and an outer layer surrounding an outer circumference of the inner layer. A density of reinforcing fiber contained in the outer layer is higher than a density of reinforcing fiber contained in the inner layer. The metal member is attached to the outer wall part so as to contact the outer layer. The reinforcing fiber contained in the outer layer has an electric insulating property.

19 Claims, 5 Drawing Sheets

CYLINDER BLOCK

TECHNICAL FIELD

The present disclosure relates to a cylinder block.

BACKGROUND OF THE DISCLOSURE

For reducing the weight of an engine for automobiles, etc. to improve fuel efficiency, various technologies of forming a cylinder block partially with resin are proposed.

For example, JP2019-015227A discloses a cylinder block which includes a metal body part having a cylinder and a resin outer wall part provided outside the body part. The outer wall part is comprised of two layers of inner and outer layers which are made of fiber reinforced resin. The outer layer is made of resin containing carbon fiber and the inner layer is made of resin containing glass fiber.

The body part in which the cylinder are formed is required to have sufficient heat resistance to the combustion gas, durability against combustion gas pressure, and durability against an axial force of cylinder head bolts, but it is difficult for the resin to satisfy such requirements. Thus, the body part is made of metal.

However, according to the cylinder block disclosed in JP2019-015227A, since the carbon fiber contained in the outer layer of the outer wall part is conductive, when the metal member contacts the outer layer (e.g., when the metal member (e.g., a boss) is attached to the outer wall part for bolt-fastening an engine component (e.g., an intake manifold) or an accessory (e.g., a starter motor), or when the cylinder block includes the metal part and the metal part partially contacts the outer layer), presence of moisture at the contact between the carbon fiber and the metal member may cause rusting (galvanic corrosion or electrolytic corrosion). Thus, a solution, such as formation of an insulating layer at the contact between the carbon fiber and the metallic member, is needed.

Further, according to the cylinder block of JP2019-015227A, the outer layer of the outer wall part is set to have a fiber density of 50 wt % or above (50-90 wt %), and the inner layer is set to have a fiber density of 60 wt % or above (60-70 wt %). That is, the fiber density is set high along the entire thickness direction of the outer wall part. Thus, the outer wall part has a high thermal effusivity along its entire thickness direction, and tends to release heat outside the cylinder block, which makes it difficult to secure heat retention.

SUMMARY OF THE DISCLOSURE

The present disclosure is made in view of the above situations, and one purpose thereof is to provide a cylinder block provided with a resin outer wall part, which can secure heat retention, improve rigidity, and prevent galvanic corrosion due to contact between the outer wall part and a metal member.

According to one aspect of the present disclosure, a cylinder block is provided, which includes a body part where a cylinder is formed, an outer wall part made of fiber reinforced resin and surrounding an outer circumference of the body part, and a metal member attached to the outer wall part. The outer wall part is comprised of an inner layer surrounding the outer circumference of the body part, and an outer layer surrounding an outer circumference of the inner layer. A density of reinforcing fiber contained in the outer layer is higher than a density of reinforcing fiber contained in the inner layer. The metal member is attached to the outer wall part so as to contact the outer layer. The reinforcing fiber contained in the outer layer has an electric insulating property.

According to this configuration, the outer wall part of the cylinder block is formed in the two-layer structure comprised of the inner layer and the outer layer, and the density of the reinforcing fiber contained in the outer layer is higher than the density of the reinforcing fiber contained in the inner layer. Therefore, it is possible to increase the rigidity of the outer layer in the outer wall part. In addition, by making the density of the reinforcing fiber in the inner layer relatively lower as compared with the outer layer, the thermal effusivity of the inner layer can be reduced to suppress the heat transfer from the body part to the inner layer. Therefore, it is possible to suppress a decrease in heat retention performance of the cylinder block.

Moreover, since the metal member is attached to the outer wall part so as to contact the outer layer and the reinforcing fiber included in the outer layer has the electric insulating property, it is possible to suppress galvanic corrosion which occurs between the reinforcing fiber having the conductivity like the carbon fiber, and the metal member.

An average thickness of the outer layer may be less than an average thickness of the inner layer.

The weight of the outer wall part may increase by setting the density of the reinforcing fiber in the outer layer higher than the inner layer. However, since the average thickness of the outer layer is less than the average thickness of the inner layer in this configuration, the outer layer is formed thinner than the inner layer, thereby suppressing the increase in the weight of the cylinder block.

The inner layer may contain hollow particles.

According to this configuration, by the inner layer containing the hollow particles, it is possible to further reduce the weight of the outer wall part.

The metal member may be a cylindrical member where a threaded hole with which a threaded member configured to give a clamping force to the outer wall part threadedly engages is formed. The outer layer may be formed so as to adhere to at least a part of an outer circumferential surface of the cylindrical member.

According to this configuration, since the outer layer with the high density of the reinforcing fiber adheres to the outer circumferential surface of the cylindrical member, it is possible to secure the strength of the outer wall part against the clamping force of the threaded member, such as a bolt.

The reinforcing fiber contained in the inner layer may have an electric insulating property. The metal member may be attached so as to contact both the outer layer and the inner layer.

According to this configuration, since not only the reinforcing fiber contained in the outer layer but also the reinforcing fiber contained in the inner layer is has the electric insulating property, it is possible to avoid galvanic corrosion, even when the metal member is attached so as to contact both the outer layer and the inner layer.

A volume ratio of the reinforcing fiber in the inner layer may be less than 70% and greater than 0%.

According to this configuration, it is possible to secure the heat retention performance of the inner layer.

The outer layer may be formed by sheets comprised of resin containing the reinforcing fiber having the electric insulating property being laminated in a thickness direction of the outer layer.

According to this configuration, it is possible to easily manage the thickness of the outer layer with sufficient accuracy, when forming the outer wall part.

The reinforcing fiber having the electric insulating property may be at least one selected from the group consisting of glass fiber, aramid fiber, and basalt fiber.

These fibers have the electric insulating property, which leads to avoiding galvanic corrosion with the metal member. In addition, they have sufficient strength to reinforce the outer wall part, and are easy to obtain on the market.

DETAILED DESCRIPTION OF THE DISCLOSURE

Hereinafter, one embodiment of the present disclosure is described in detail with reference to the accompanying drawings.

Figure 1:
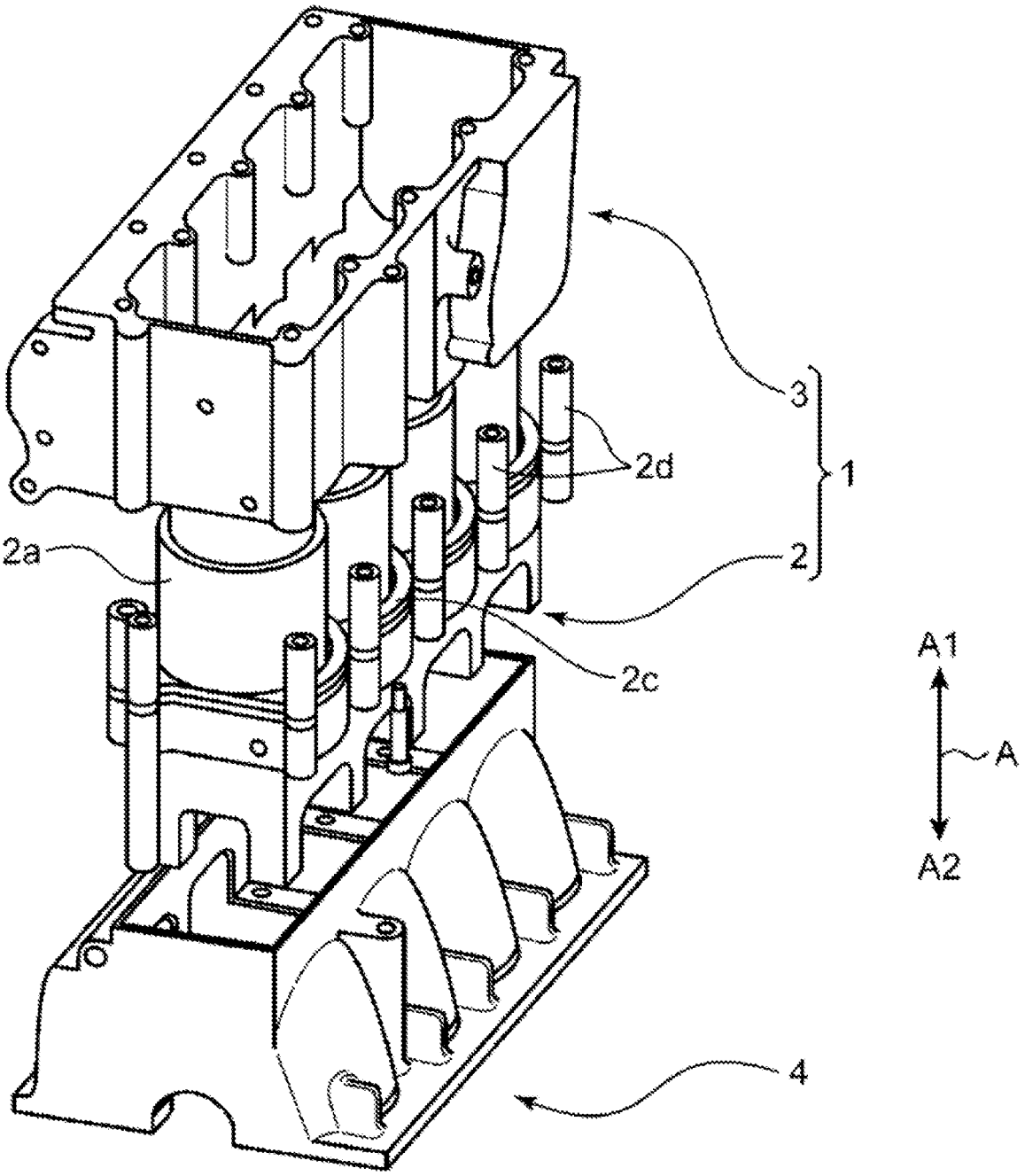
FIG. 1 is an exploded perspective view illustrating the overall configuration of a cylinder block according to one embodiment of the present disclosure.
Figure 2:
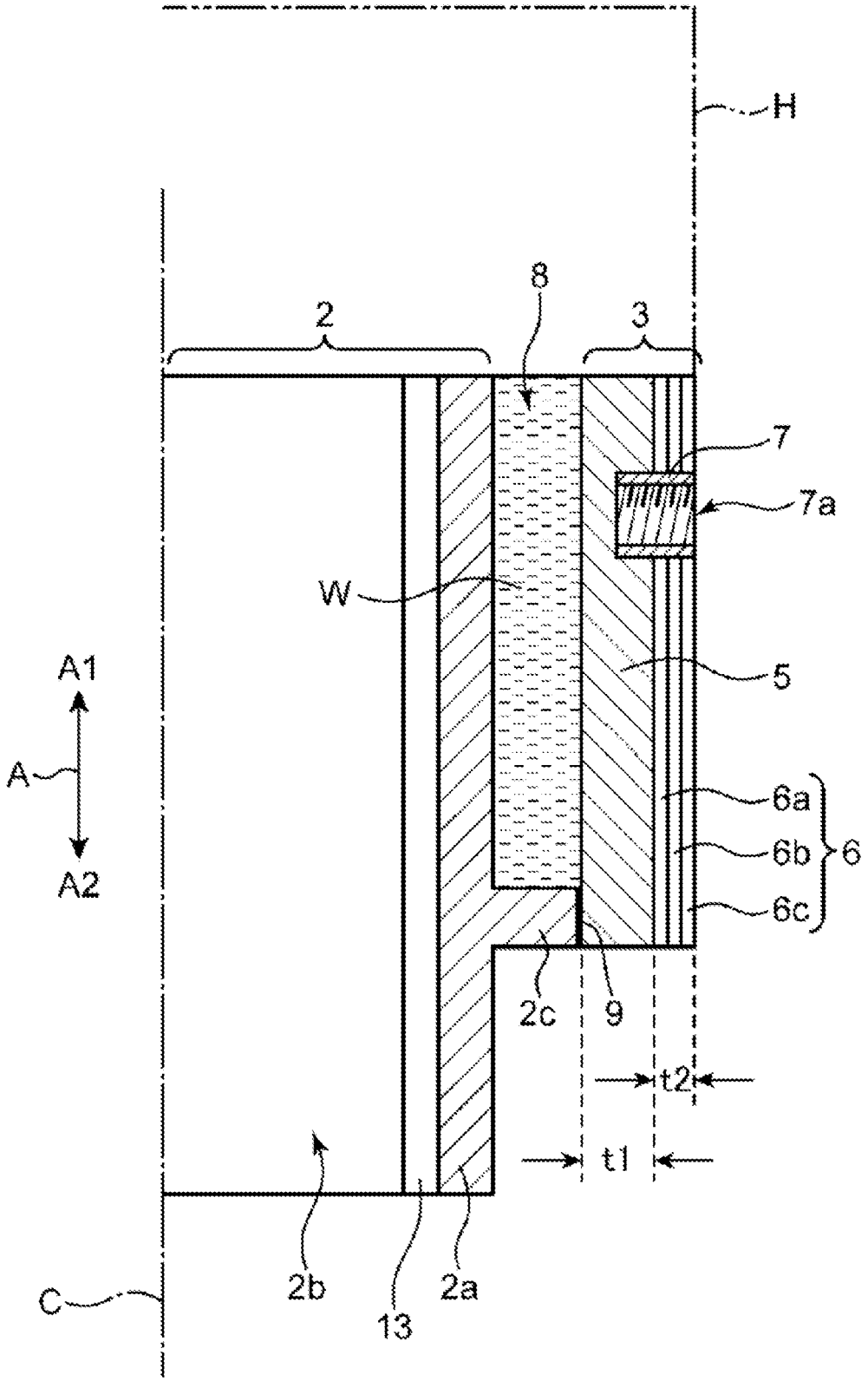
FIG. 2 is an enlarged cross-sectional view of the cylinder block of FIG. 1.

As illustrated in FIGS. 1 and 2, a cylinder block 1 includes a body part 2 in which cylinders 2*b* extending in a vertical direction A about an axis C is formed, an outer wall part 3 made of a fiber reinforced resin which surrounds the perimeter of the body part 2, and a boss part 7 as a metal member attached to the outer wall part 3. An inner circumferential surface of each cylinder 2*b* is covered with a cylinder liner 13. As illustrated in FIG. 1, a crankcase 4 is attached to one end face of the body part 2 of the cylinder block 1 at a downward side A2. A cylinder head H is fixed to the other end face of the cylinder block 1 (both the body part 2 and the outer wall part 3) at an upward side A1 with cylinder-head bolts.

Although the engine according to this embodiment is a multi-cylinder engine, only one of the cylinders is described below in the interest of simplifying the description.

The body part 2 includes a circumferential wall 2*a* which forms the cylinder 2*b* having a cylindrical shape extending in the vertical direction A, a bottom-wall forming part 2*c* which protrudes outwardly from an external surface of the circumferential wall 2*a*, and a plurality of boss parts 2*d*. The body part 2 is made of a metal, such as an aluminum alloy, with a high heat resistance and high strength.

Here, the formation of the cylinder 2*b* means integrating the cylinder 2*b* manufactured separately from the circumferential wall 2*a* with the body part 2 by casting the body part 2 together with the cylinder 2*b*, or machining the cast body part 2 to form the cylindrical body (the cylinder 2*b*).

A cooling water passage 8 for circulating coolant W through the outer circumference of the body part 2 is formed by the circumferential wall 2*a* of the body part 2, the bottom-wall forming part 2*c*, and the outer wall part 3 (particularly, an inner layer 5) which covers the body part 2 from outside. A space between the bottom-wall forming part 2*c* and the outer wall part 3 (particularly, the inner layer 5) is sealed with a packing 9.

The outer wall part 3 is comprised of the inner layer 5 which surrounds the outer circumference of the body part 2, and an outer layer 6 which surrounds the outer circumference of the inner layer 5.

At least the outer layer 6 among the inner layer 5 and the outer layer 6 is made of a fiber reinforced resin having an electric insulating property. In this embodiment, both the inner layer 5 and the outer layer 6 are made of the fiber reinforced resin having the electric insulating property.

The fiber reinforced resin having the electric insulating property contains at least one of fibers selected from a group consisted of glass fiber, aramid fiber, and basalt fiber.

A density of the reinforcing fiber contained in the outer layer 6 is higher than a density of the reinforcing fiber contained in the inner layer 5.

For example, the weight percentage of the reinforcing fiber contained in the outer layer 6 is about 35 wt % when the aramid fiber is used, and about 54 wt % when the glass fiber is used.

On the other hand, the weight percentage of the reinforcing fiber contained in the inner layer 5 is set as 30 wt % when the glass fiber is used. Note that it is desirable for the inner layer 5 to contain hollow particles for improving heat retention performance.

Moreover, in order to suppress an increase in the weight of the outer wall part 3, an average thickness t2 of the outer layer 6 with the high-density reinforcing fiber (e.g., an average thickness in the circumferential direction of the cylinder block) is desirably less than the average thickness t1 of the inner layer 5. Here, the term "average thickness" as used herein refers to an average value of the thickness of a flat part where neither bosses nor ribs are formed.

As illustrated in FIG. 2, the outer layer 6 of this embodiment is constructed by sheets 6*a*, 6*b*, and 6*c* made of resin containing the reinforcing fiber having the electric insulating property being laminated in the thickness direction of the outer layer 6. For example, the sheets 6*a*, 6*b*, and 6*c* are sheets where the reinforcing fiber is oriented in the surface direction, and may be made of nonwoven fabric where the reinforcing fiber is oriented randomly in the surface direction. Note that the reinforcing fiber may be oriented in an arbitrary direction in the sheet surface.

Each boss part 7 is a cylindrical member made of metal, such as steel, where a threaded hole 7*a* with which a threaded member for giving a clamping force to the outer wall part 3 threadedly engages is formed. The boss part 7 is used for bolt-fastening engine components, such as an intake manifold and an exhaust manifold, and auxiliary machinery, such as a starter, to the outer wall part 3.

The boss part 7 is attached to an outer circumferential surface of the outer wall part 3 at such a suitable position that it contacts the outer layer 6. In this embodiment, since both the inner layer 5 and the outer layer 6 are made of the fiber reinforced resin having the electric insulating property, such as the glass fiber, the possibility of occurrence of the galvanic corrosion is low, even if the boss part 7 is attached so that it contacts both the outer layer 6 and the inner layer 5 as illustrated in FIG. 2.

Since the outer layer 6 is formed so as to adhere to at least a part of the outer circumferential surface of the boss part 7, it is possible to secure the strength against the clamping force when fastening the threaded member to the boss part 7. In the example illustrated in FIG. 2, a part of an opening edge around the boss part 7 in the sheets 6*a*, 6*b*, and 6*c* of the outer layer 6 is adhered to the outer circumferential surface of the boss part 7 to secure the strength against the clamping force.

A volume ratio of the reinforcing fiber in the inner layer 5 is desirably less than 70% in order to secure the heat retention performance of the cylinder block 1. The volume ratio may be calculated as a ratio of the volume of the reinforcing fibers within the layer to the total volume of the inner layer 5. The reason for the volume ratio is as follows.

Figure 3:
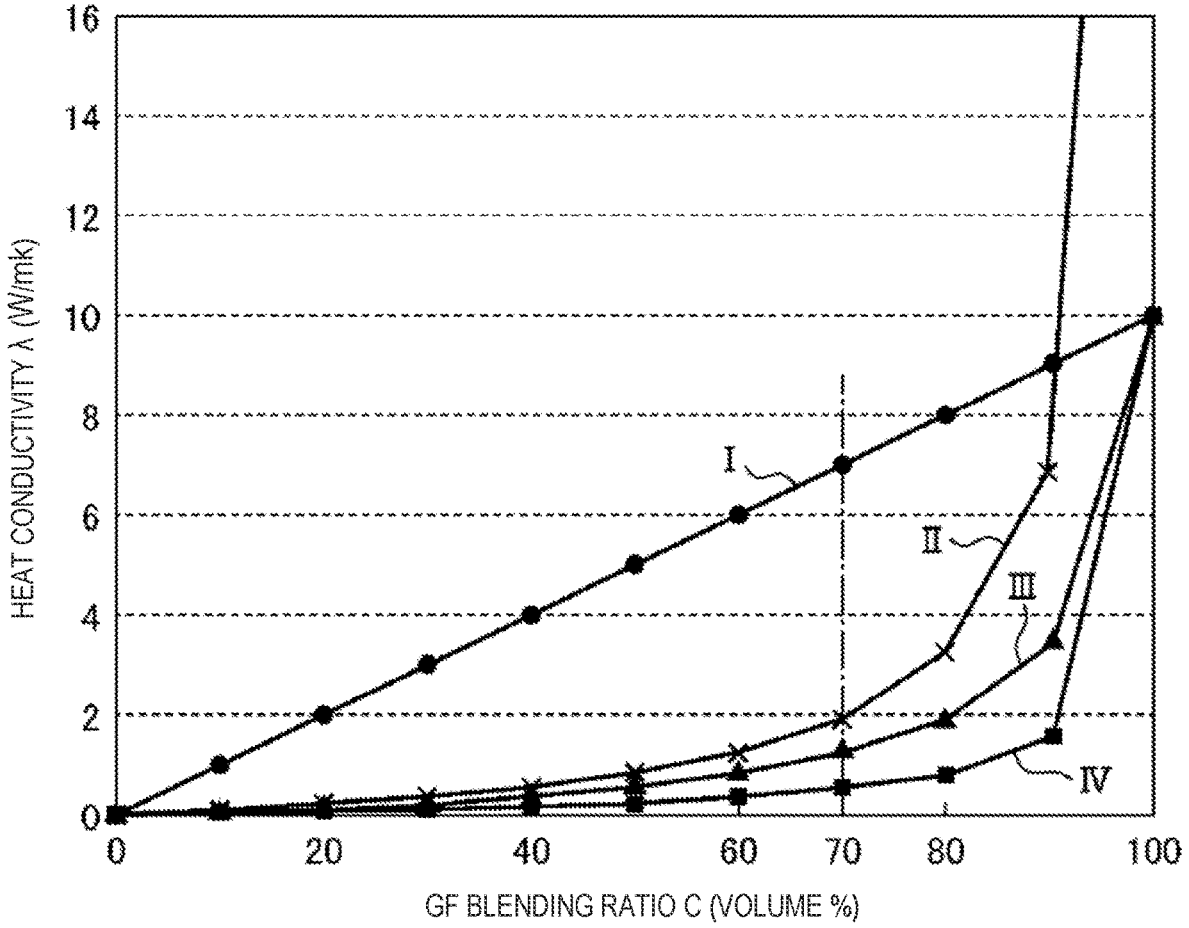
FIG. 3 is a graph illustrating a relationship between a glass-fiber blending ratio and a heat conductivity of a glass-fiber resin used for an outer wall part of FIG. 1 by four kinds of calculation methods.

FIG. 3 is a graph illustrating relationships between a glass-fiber (GF) blending ratio c (volume %) and a heat conductivity λ (W/m·K) when the glass fiber is used as the reinforcing fiber, which are calculated by four kinds of different expressions. [I] is a straight line calculated from a compound rule, [II] is a curve calculated from a series equation, [III] is a curve calculated from a Maxwell equation, and [IV] is a curve calculated from a Meredith equation.

Note that the series equation is a formula for calculating the heat conductivity of the entire model when glass-fiber resin is used as a series model in which glass fiber and the resin are connected in series.

Looking at the graph of FIG. 3, it can be seen that, as for the straight line I, the heat conductivity λ increases at a fixed rate in proportion to a GF blending ratio c, but as for the other curves II-IV, the heat conductivity λ increases rapidly when the GF blending ratio c becomes 70% or more, thereby reducing the heat retention performance. Therefore, it is desirable that the GF blending ratio c is less than 70% in order to secure the heat retention performance of the cylinder block 1.

For example, When manufacturing the outer wall part 3 having the two-layer structure of the inner layer 5 and the outer layer 6 which are made of the fiber reinforced resin described above, one sheet or a plurality of laminated sheets of nonwoven fabric sheet including a plurality of glass fibers which constitutes the outer layer 6 is placed on an inner circumferential surface of a die, and a molten resin material containing short glass fibers used as the material of the inner layer 5 is then poured into the die.

Features of this Embodiment (1) The cylinder block 1 of this embodiment includes the body part 2 in which the cylinder is formed, the outer wall part 3 made of the fiber reinforced resin which surrounds the outer circumference of the body part 2, and the boss part 7 as the metal member attached to the outer wall part 3. The outer wall part 3 is comprised of the inner layer 5 which surrounds the outer circumference of the body part 2, and the outer layer 6 which surrounds the outer circumference of the inner layer 5. The density of the reinforcing fiber contained in the outer layer 6 is higher than the density of the reinforcing fiber contained in the inner layer 5. The boss part 7 is attached to the outer wall part 3 so as to contact the outer layer 6. The reinforcing fiber contained in the outer layer 6 is the reinforcing fiber having the electric insulating property.

With this configuration, the outer wall part 3 of the cylinder block 1 is formed in the two-layer structure comprised of the inner layer 5 and the outer layer 6, and the density of the reinforcing fiber contained in the outer layer 6 is higher than the density of the reinforcing fiber contained in the inner layer 5. Therefore, it is possible to increase the rigidity of the outer layer 6 in the outer wall part 3. In addition, by making the density of the reinforcing fiber in the inner layer 5 relatively low as compared with the outer layer 6, the thermal effusivity of the inner layer 5 can be reduced to suppress the heat transfer from the body part 2 to the inner layer 5. Therefore, it is possible to suppress the decrease in heat retention performance of the cylinder block 1.

Moreover, since the boss part 7 is attached to the outer wall part 3 so as to contact the outer layer 6 and the reinforcing fiber included in the outer layer 6 is the reinforcing fiber having the electric insulating property, it is possible to suppress the galvanic corrosion which occurs between the reinforcing fiber having the conductivity like the carbon fiber, and the boss part 7.

(2) In the cylinder block 1 of this embodiment, the average thickness t2 of the outer layer 6 is less than the average thickness t1 of the inner layer 5.

The weight of the outer wall part 3 may increase by setting the density of the reinforcing fiber in the outer layer 6 higher than the inner layer 5. However, since the average thickness of the outer layer 6 is less than the average thickness of the inner layer 5 as described above, the outer layer 6 is formed thinner than the inner layer 5, thereby suppressing the increase in the weight of the cylinder block 1.

(3) In the cylinder block 1 of this embodiment, the inner layer 5 desirably contains the hollow particles. By the inner layer 5 containing the hollow particles, it is possible to further reduce the weight of the outer wall part 3. In addition, by the inner layer 5 containing the hollow particles, it is also possible to improve the heat retaining effect of the inner layer 5.

(4) In the cylinder block 1 of this embodiment, the boss part 7 as the metal member is the cylindrical member in which the threaded hole 7*a* with which the threaded member for giving the clamping force to the outer wall part 3 threadedly engages is formed. The outer layer 6 is formed so as to adhere to at least a part of the outer circumferential surface of the cylindrical member.

With this configuration, since the outer layer 6 with the high density of the reinforcing fiber adheres to the outer circumferential surface of the cylindrical member, it is possible to secure the strength of the outer wall part 3 against the clamping force of the threaded member, such as the bolt.

(5) In the cylinder block 1 of this embodiment, the reinforcing fiber contained in the inner layer 5 is the reinforcing fiber having the electric insulating property. The boss part 7 is attached so as to contact both the outer layer 6 and the inner layer 5.

With this configuration, since not only the reinforcing fiber contained in the outer layer 6 but also the reinforcing fiber contained in the inner layer 5 is the reinforcing fiber having the electric insulating property, it is possible to avoid the galvanic corrosion, even when the boss part 7 is attached so as to contact both the outer layer 6 and the inner layer 5.

(6) In the cylinder block 1 of this embodiment, the volume ratio of the reinforcing fiber in the inner layer 5 is less than 70% and greater than 0%. With this configuration, it is possible to secure the heat retention performance of the inner layer 5.

(7) In the cylinder block 1 of this embodiment, the outer layer 6 is constructed by the sheets 6*a*, 6*b*, and 6*c* made of the resin containing the reinforcing fiber having the electric insulating property being laminated in the thickness direction of the outer layer 6. With this configuration, it is possible to easily manage the thickness t2 of the outer layer 6 with sufficient accuracy, when forming the outer wall part 3. Note that an adhesive layer may be provided between the sheets 6*a*, 6*b*, and 6*c* for the easiness of forming the laminated the sheets.

(8) In the cylinder block 1 of this embodiment, the reinforcing fiber having the electric insulating property is at least one of fibers selected from the group consisting of the glass fiber, the aramid fiber, and the basalt fiber. These fibers have the electric insulating property, which leads to avoiding the galvanic corrosion with the boss part 7. In addition, they have sufficient strength as the reinforcing fibers which reinforce the outer wall part 3, and are easy to obtain in the market. Note that considering the scope of the present disclosure, the phrase "having the electric insulating property" may be an insulating property which can at least avoid the galvanic corrosion, and it does not necessarily mean that it is fully insulated.

Modifications (A) In the above embodiment, as illustrated in FIG. 2, the part of the opening edge around the boss part 7 in the sheets 6*a*, 6*b*, and 6*c* of the outer layer 6 adheres to the outer circumferential surface of the boss part 7 to secure the strength against the clamping force. However, the present disclosure is not limited to this configuration, as long as the outer layer 6 adheres to at least a part of the outer circumferential surface of the boss part 7 which is the cylindrical member. Therefore, the outer layer 6 may adhere to the entire outer circumferential surface of the boss part 7.

Figure 4:
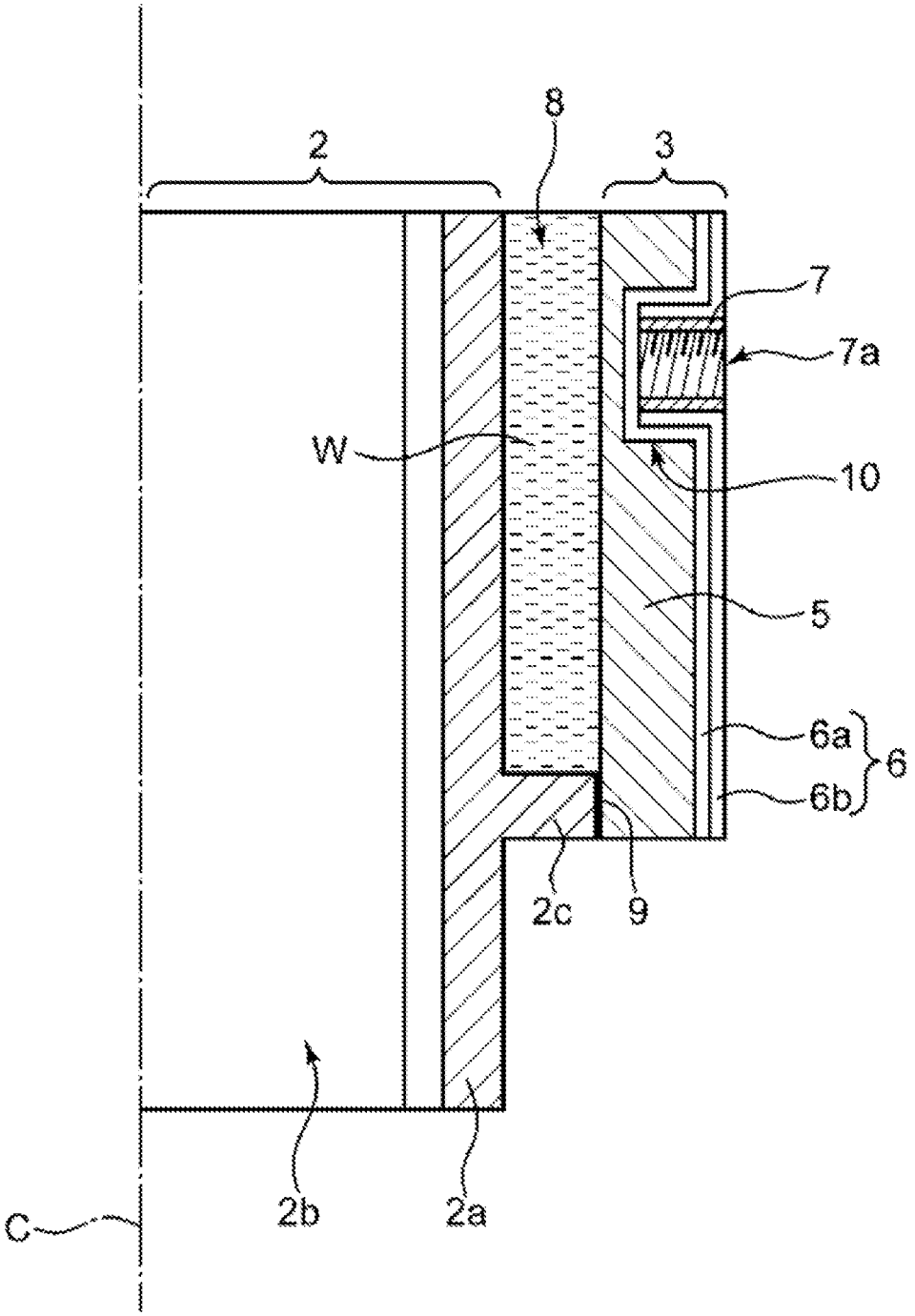
FIG. 4 is an enlarged cross-sectional view of a cylinder block according to a modification of the present disclosure.

That is, like a modification of the present disclosure illustrated in FIG. 4, the sheets 6*a* and 6*b* of the outer layer 6 may be bent toward the inner layer 5 to form a cylindrical part 10, and the cylindrical part 10 of the outer layer 6 may adhere to the entire outer circumferential surface of the boss part 7. In this case, since the cylindrical part 10 of the outer layer 6 contacts the outer circumferential surface of the boss part 7 with a large contacting area to firmly support the boss part 7, the strength of the outer wall part 3 against the clamping force of the threaded member can fully be secured.

Moreover, in the modification illustrated in FIG. 4, the sheet 6*a* which constitutes the outer layer 6 made of the fiber reinforced resin having the electric insulating property is provided between an end part of the boss part 7 and the inner layer 5. Therefore, it is possible to avoid the galvanic corrosion, even if the inner layer 5 is a layer containing the carbon resin.

(B) In the above embodiment, as illustrated in FIG. 2, the metal boss part 7 for attaching the engine components such as the intake manifold and the auxiliary machinery such as the starter is described as one example of the metal member attached to the outer layer 6 of the outer wall part 3. However, the metal member of the present disclosure is not limited to the boss part 7, and it may include various members, as long as it is a metal member attached to the outer layer 6 of the outer wall part 3.

Figure 5:
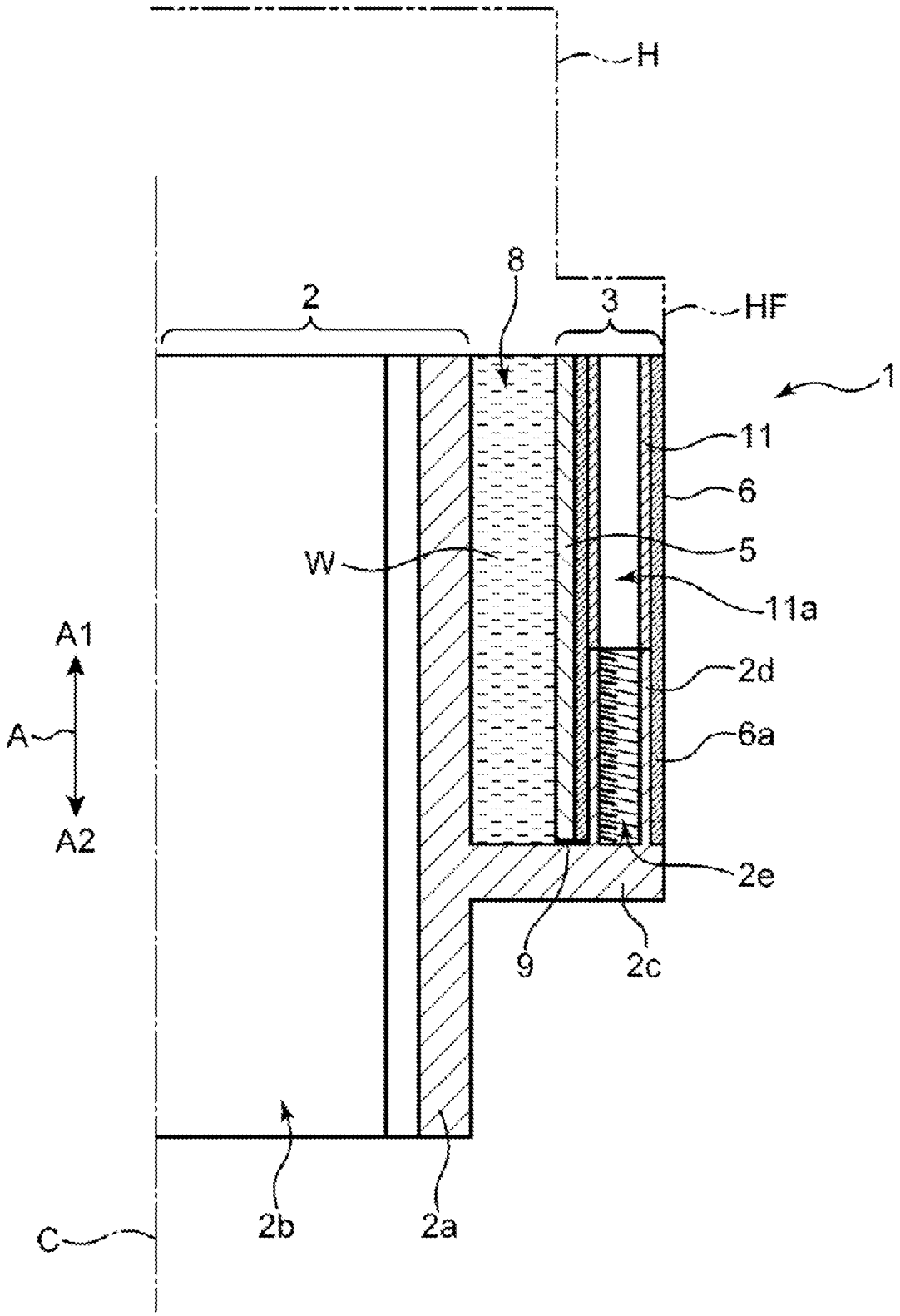
FIG. 5 is an enlarged cross-sectional view of a cylinder block according to another modification of the present disclosure.

For example, as another modification of the present disclosure, as illustrated in FIG. 5, a flange part HF of a cylinder head H may be fastened to an end face of the cylinder block 1 at the upward side A1 with cylinder-head bolts. Metal cylindrical members 11 which each form a cylinder-head-bolt hole 11*a* into which the cylinder-head bolt is inserted in the vertical direction A may be attached to the outer layer 6.

The cylindrical member 11 extends in the vertical direction A like the cylinder 2*b* of the body part 2. Although the outer wall part 3 of FIG. 5 is common to the above embodiment in that it has the two-layer structure of the inner layer 5 and the outer layer 6, the configuration of the outer layer 6 is different. That is, the outer layer 6 of FIG. 5 is formed in a cylindrical shape by wrapping a sheet around the outer circumference of the cylindrical member 11. The outer layer 6 adheres to the entire outer circumferential surface of the cylindrical member 11. This sheet is, for example, a sheet made of nonwoven fabric containing the reinforcing fiber having the electric insulating property, such as the glass fiber.

The outer layer 6 of FIG. 5 has a cylindrical extended part 6*a* extending to a lower part of the cylindrical member 11, and a boss part 2*d* of the body part 2 are inserted therein.

In a modification illustrated in FIG. 5, when fastening the cylinder head H to the end face of the cylinder block 1 at the upward side A1 with the cylinder-head bolts, the cylinder-head bolt penetrates the cylinder-head-bolt hole 11*a* extending in the vertical direction A, and a tip-end part of the cylinder-head bolt is then threadedly engaged with a threaded hole 2*e* of the boss part 2*d*. Therefore, the cylinder head H and the cylinder block 1 are fastened in the vertical direction with the cylinder-head bolts. Here, the fastening force of the bolts in the vertical direction A acts on the outer layer 6 through the cylindrical member 11. However, since the outer layer 6 fixedly adheres to the entire outer circumferential surface of the cylindrical member 11, the outer layer 6 contacts the outer circumferential surface of the cylindrical member 11 with a large contacting area to firmly support the cylindrical member 11. Therefore, it is possible to fully secure the strength of the outer wall part 3 against the clamping force of the cylinder-head bolts.

(C) Although in the above embodiment both the inner layer 5 and the outer layer 6 are made of the fiber reinforced resin having the electric insulating property, only the outer layer 6 may be made of the fiber reinforced resin having the electric insulating property. For example, only the outer layer 6 may be made of the fiber reinforced resin having the electric insulating property, and the inner layer 5 may be made of the carbon resin. In this case, like the above modification (A) and FIG. 4, by providing the sheet 6*a* which constitutes the outer layer 6 made of the fiber reinforced resin having the electric insulating property between the end part of the boss part 7 and the inner layer 5, it is possible to avoid the galvanic corrosion, even if the inner layer 5 is the layer containing the carbon resin.

(D) In the above embodiment, the weight percentage of the reinforcing fiber contained in the inner layer 5 when the glass fiber is used is set as 30 wt %, but the present disclosure is not limited to this configuration. For example, as a modification of the present disclosure, when the inner layer 5 contains the carbon fiber, the weight percentage of the carbon fiber may be 5 wt %. Alternatively, when using the carbon fiber as the inner layer 5, the weight percentage of the carbon fiber may be 30 wt %, and 35 wt % of glass balloons may further be utilized as the hollow particles, to further improve the heat retaining effect while suppressing the increase in the weight of the cylinder block 1.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Cylinder Block
2 Body Part
3 Outer Wall Part
5 Inner Layer

6 Outer Layer
7 Boss Part (Metal Member)
7*a* Threaded Hole
11 Cylindrical Member (Metal Member)
11*a* Cylinder-head-bolt Hole

What is claimed is:

1. A cylinder block, comprising:
a body part where a cylinder is formed;
an outer wall part made of fiber reinforced resin and surrounding an outer circumference of the body part; and
a metal member attached to the outer wall part,
wherein the outer wall part is comprised of an inner layer surrounding the outer circumference of the body part, and an outer layer surrounding an outer circumference of the inner layer,
wherein a density of reinforcing fiber contained in the outer layer is higher than a density of reinforcing fiber contained in the inner layer,
wherein the metal member is attached to the outer wall part so as to contact the outer layer, and
wherein the reinforcing fiber contained in the outer layer has an electric insulating property.

2. The cylinder block of claim 1, wherein an average thickness of the outer layer is less than an average thickness of the inner layer.

3. The cylinder block of claim 2, wherein the inner layer contains hollow particles.

4. The cylinder block of claim 3,
wherein the metal member is a cylindrical member where a threaded hole with which a threaded member configured to give a clamping force to the outer wall part threadedly engages is formed, and
wherein the outer layer is formed so as to adhere to at least a part of an outer circumferential surface of the cylindrical member.

5. The cylinder block of claim 4,
wherein the reinforcing fiber contained in the inner layer has an electric insulating property, and
wherein the metal member is attached so as to contact both the outer layer and the inner layer.

6. The cylinder block of claim 5, wherein a volume ratio of the reinforcing fiber in the inner layer is less than 70% and greater than 0%.

7. The cylinder block of claim 6, wherein the outer layer is formed by sheets comprised of resin containing the reinforcing fiber having the electric insulating property being laminated in a thickness direction of the outer layer.

8. The cylinder block of claim 7, wherein the reinforcing fiber having the electric insulating property is at least one selected from the group consisting of glass fiber, aramid fiber, and basalt fiber.

9. The cylinder block of claim 1, wherein the inner layer contains hollow particles.

10. The cylinder block of claim 1,
wherein the metal member is a cylindrical member where a threaded hole with which a threaded member configured to give a clamping force to the outer wall part threadedly engages is formed, and
wherein the outer layer is formed so as to adhere to at least a part of an outer circumferential surface of the cylindrical member.

11. The cylinder block of claim 1,
wherein the reinforcing fiber contained in the inner layer has an electric insulating property, and
wherein the metal member is attached so as to contact both the outer layer and the inner layer.

12. The cylinder block of claim 1, wherein a volume ratio of the reinforcing fiber in the inner layer is less than 70% and greater than 0%.

13. The cylinder block of claim 1, wherein the outer layer is formed by sheets comprised of resin containing the reinforcing fiber having the electric insulating property being laminated in a thickness direction of the outer layer.

14. The cylinder block of claim 1, wherein the reinforcing fiber having the electric insulating property is at least one selected from the group consisting of glass fiber, aramid fiber, and basalt fiber.

15. The cylinder block of claim 2, wherein the outer layer is formed by sheets comprised of resin containing the reinforcing fiber having the electric insulating property being laminated in a thickness direction of the outer layer.

16. The cylinder block of claim 2, wherein the reinforcing fiber having the electric insulating property is at least one selected from the group consisting of glass fiber, aramid fiber, and basalt fiber.

17. The cylinder block of claim 9,
wherein the reinforcing fiber contained in the inner layer has an electric insulating property, and
wherein the metal member is attached so as to contact both the outer layer and the inner layer.

18. The cylinder block of claim 17, wherein a volume ratio of the reinforcing fiber in the inner layer is less than 70% and greater than 0%.

19. The cylinder block of claim 18, wherein the reinforcing fiber having the electric insulating property is at least one selected from the group consisting of glass fiber, aramid fiber, and basalt fiber.

* * * * *